US011980227B2

(12) United States Patent
Kim et al.

(10) Patent No.: US 11,980,227 B2
(45) Date of Patent: May 14, 2024

(54) VAPORIZER AND AEROSOL GENERATING DEVICE COMPRISING THE SAME

(71) Applicant: KT&G CORPORATION, Daejeon (KR)

(72) Inventors: Tae Hun Kim, Yongin-si (KR); Hun Il Lim, Seoul (KR); Hyung Jin Jung, Seoul (KR); Jae Sung Choi, Seoul (KR); Jung Ho Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 585 days.

(21) Appl. No.: 17/273,010

(22) PCT Filed: Oct. 6, 2020

(86) PCT No.: PCT/KR2020/013572
§ 371 (c)(1),
(2) Date: Mar. 3, 2021

(87) PCT Pub. No.: WO2021/071201
PCT Pub. Date: Apr. 15, 2021

(65) Prior Publication Data

US 2022/0295886 A1 Sep. 22, 2022

(30) Foreign Application Priority Data

Oct. 11, 2019 (KR) ..... 10-2019-0126294

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/20* (2020.01); *A24F 40/30* (2020.01); *A24F 40/42* (2020.01); *A24F 40/485* (2020.01)

(58) Field of Classification Search
CPC ..... A24F 40/44; A24F 40/10; A24F 40/20; A24F 40/30; A24F 40/42; A24F 40/485;
(Continued)

(56) References Cited

U.S. PATENT DOCUMENTS 9,986,762 B2 6/2018 Alarcon et al.
10,104,909 B2 * 10/2018 Han ..... H05B 3/46
(Continued)

FOREIGN PATENT DOCUMENTS

CN 108883242 A 11/2018
EP 3 622 838 A2 3/2020
(Continued)

OTHER PUBLICATIONS

Translation of Office Action dated Jan. 27, 2021 in Korean Application No. 10-2019-0126294.
(Continued)

*Primary Examiner* — Edwin A. Leon
(74) *Attorney, Agent, or Firm* — Sughrue Mion, PLLC

(57) ABSTRACT

A vaporizer includes a liquid storage for storing an aerosol generating material, an upper cap having a liquid inlet through which the aerosol generating material is introduced, a lower cap coupled to the upper cap to form an aerosol generating space together with the upper cap, a liquid delivery element that is arranged in the aerosol generating space and absorbs the aerosol generating material delivered from the liquid storage, and a heating element that generates an aerosol by heating the aerosol generating material absorbed by the liquid delivery element, wherein the lower
(Continued)

cap may include a support groove for supporting at least part of the liquid delivery element and inner walls facing both ends of the liquid delivery element.

9 Claims, 2 Drawing Sheets

(51) Int. Cl.

| | |
|---|---|
| ***A24F 40/20*** | (2020.01) |
| ***A24F 40/30*** | (2020.01) |
| ***A24F 40/42*** | (2020.01) |
| ***A24F 40/485*** | (2020.01) |

(58) Field of Classification Search
CPC ..... A24F 40/48; A24F 40/40; A24F 47/00; A24F 40/46
See application file for complete search history.

(56) References Cited

U.S. PATENT DOCUMENTS

| | | | | |
|---|---|---|---|---|
| 11,051,550 | B2 * | 7/2021 | Lin | A24F 40/485 |
| 11,178,910 | B2 | 11/2021 | Kim et al. | |
| 11,213,638 | B2 | 1/2022 | Nettenstrom et al. | |
| 2004/0089314 | A1 * | 5/2004 | Felter | A24F 40/51 131/194 |
| 2015/0020831 | A1 * | 1/2015 | Weigensberg | A24F 40/90 131/329 |
| 2016/0128386 | A1 | 5/2016 | Chen | |
| 2017/0214261 | A1 * | 7/2017 | Gratton | H02J 7/00714 |
| 2018/0049472 | A1 * | 2/2018 | Mahler | A61M 15/0023 |
| 2019/0046745 | A1 | 2/2019 | Nettenstrom et al. | |
| 2019/0099561 | A1 | 4/2019 | Nettenstrom | |

FOREIGN PATENT DOCUMENTS

| | | | |
|---|---|---|---|
| KR | 10-2013-0005328 | A | 1/2013 |
| KR | 10-2016-0005323 | A | 1/2016 |
| KR | 10-2016-0082570 | A | 7/2016 |
| KR | 10-2018-0117654 | A | 10/2018 |
| KR | 10-2018-0124736 | A | 11/2018 |
| WO | 2018/208078 | A2 | 11/2018 |

OTHER PUBLICATIONS

Extended European Search Report dated Nov. 19, 2021 in EP Application No. 20861972.6.
Office Action dated Apr. 24, 2023 from the Chinese Patent Office in Application No. 202080006032.6.
Korean office action for Korean application 10-2019-0126294 dated Jan. 27, 2021.
Written opinion for PCT/KR2020/013572 dated Jan. 13, 2021.
International search report for PCT/KR2020/013572 dated Jan. 13, 2021.

* cited by examiner

[Fig. 1]
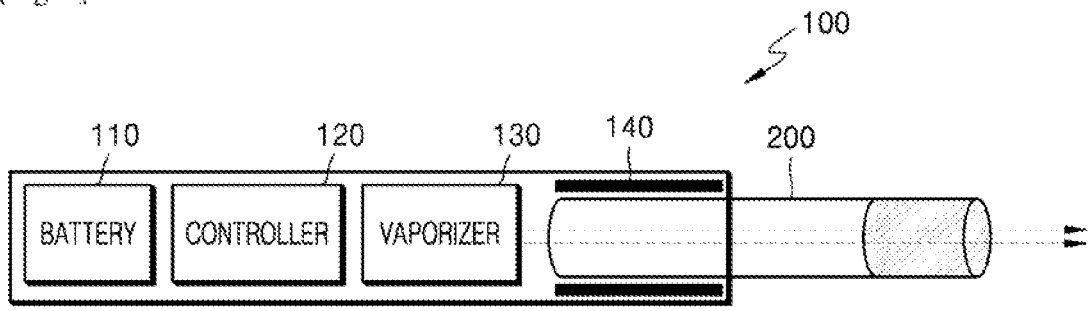
[Fig. 2]
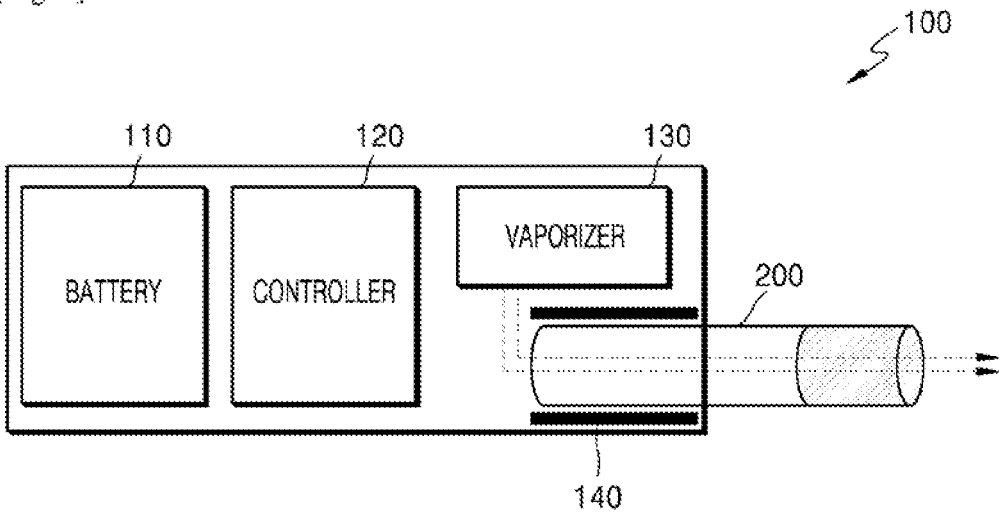
[Fig. 3]
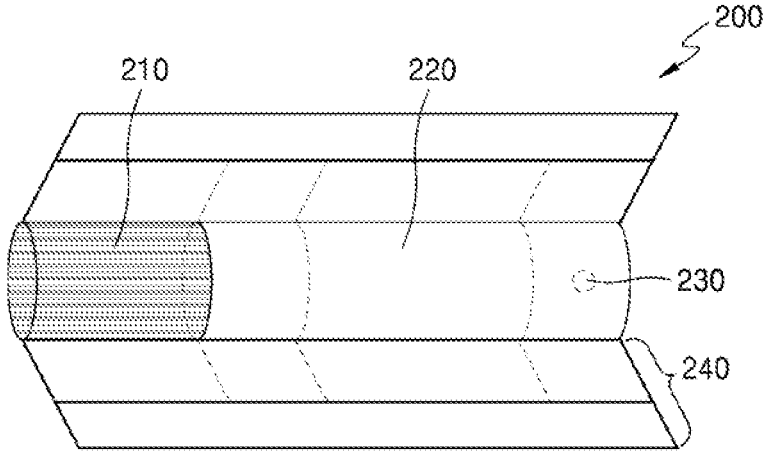

[Fig. 4]
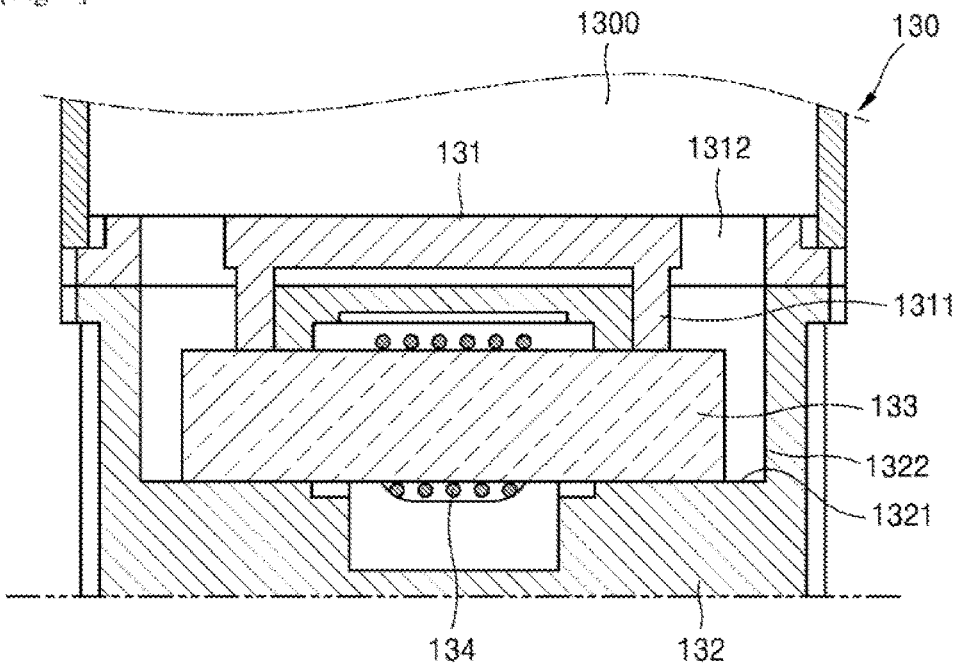
[Fig. 5]
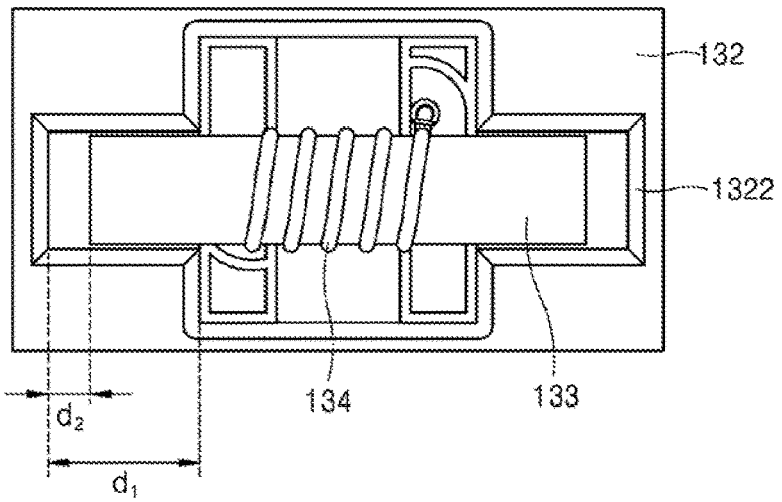
[Fig. 6]
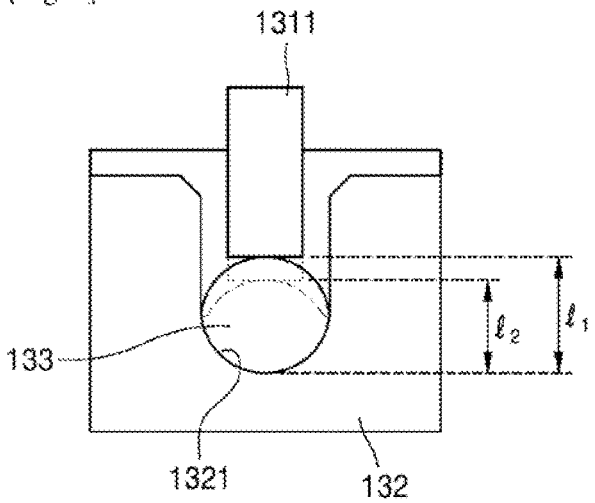

VAPORIZER AND AEROSOL GENERATING DEVICE COMPRISING THE SAME

CROSS-REFERENCE TO RELATED APPLICATIONS

This application is a National Stage of International Application No. PCT/KR2020/013572 filed Oct. 6, 2020, which claims priority under U.S.C. § 119(a) to Korean Patent Application No. 10-2019-0126294 filed on Oct. 11, 2019.

TECHNICAL FIELD

The present disclosure relates to a vaporizer aid an aerosol generating device including the vaporizer, and more particularly, to a vaporizer having an increased aerosol generation amount and an aerosol generating device including the vaporizer.

BACKGROUND ART

Recently, the demand for alternatives to traditional combustive cigarettes has increased. For example, there is growing demand for an aerosol generating device that generates an aerosol by heating an aerosol generating material, rather than by combusting cigarettes. Accordingly, studies on a heating-type cigarette and a heating-type aerosol generating device have been actively conducted.

A heating-type aerosol generating device may include, for example, an aerosol generating material therein. In this case, a problem may occur in that an aerosol is not sufficiently generated when an aerosol generating material is not delivered smoothly.

DISCLOSURE OF INVENTION

Solution to Problem

The present embodiments provide a vaporizer that may solve the above-described problem and an aerosol generating device including the vaporizer.

A vaporizer according to one embodiment includes a liquid storage for storing an aerosol generating material, an upper cap having a liquid inlet through which the aerosol generating material is introduced, a lower cap coupled to the upper cap to form an aerosol generating space between the upper cap and the lower cap, a liquid delivery element that is arranged in the aerosol generating space and absorbs the aerosol generating material delivered from the liquid storage, and a heating element that generates an aerosol by heating the aerosol generating material absorbed by the liquid delivery element, wherein the lower cap may include a support groove for supporting at least part of the liquid delivery element and an inner wall facing the end of the liquid delivery element.

Advantageous Effects of Invention

A vaporizer and an aerosol generating device including the vaporizer according to the embodiments may smoothly deliver a liquid through a liquid delivery element, and thus, the amount of generated aerosol may be increased and the vaporizer may be prevented from leaking.

Effects of the embodiments are not limited to the above-described effects, and effects that are not described will be clearly understood by those skilled in the art from the present specification and the accompanying drawings.

BRIEF DESCRIPTION OF DRAWINGS

FIGS. 1 and 2 are views illustrating examples in which a cigarette is inserted into an aerosol generating device according to an embodiment.

FIG. 3 is an exploded view illustrating an embodiment of the cigarette illustrated in FIGS. 1 and 2.

FIG. 4 is a cross-sectional view of a side surface of the vaporizer illustrated in FIGS. 1 and 2.

FIG. 5 is a cross-sectional view of an upper surface of the vaporizer illustrated in FIGS. 1 and 2.

FIG. 6 is a cross-sectional view of a side surface of the vaporizer illustrated in a direction perpendicular to the direction illustrated in FIG. 4.

BEST MODE FOR CARRYING OUT THE INVENTION

A vaporizer according to one embodiment includes a liquid storage for storing an aerosol generating material, an upper cap having a liquid inlet through which the aerosol generating material is introduced, a lower cap coupled to the upper cap to form an aerosol generating space between the upper cap and the lower cap, a liquid delivery element that is arranged in the aerosol generating space and absorbs the aerosol generating material delivered from the liquid storage, and a heating element that generates an aerosol by heating the aerosol generating material absorbed by the liquid delivery element, wherein the lower cap may include a support groove for supporting at least part of the liquid delivery element and an inner wall facing an end of the liquid delivery element.

In addition, the end of the liquid delivery element may be spaced apart from the inner wall.

In addition, the support groove may extend from the inner walls of the lower cap toward the center of the lower cap to support the end of the liquid delivery element.

In addition, a ratio of a length of the support groove and a distance between the end of the liquid delivery element and the inner wall may be in a range of 1.1 to 35.

In addition, the distance between the end of the liquid delivery element and the inner wall may be in a range of 0.1 mm to 3 mm.

In addition, an area of the liquid inlet may be reduced as the distance between the end of the liquid delivery element and the inner walls increases.

In addition, the area of the liquid inlet may be in a range of 5 $mm^2$ to 10 $mm^2$.

In addition, the upper cap may include a pressing portion for pressing the liquid delivery element toward the lower cap.

In addition, a ratio between a height of the liquid delivery element after being deformed by the pressing portion and a height of the liquid delivery element before being deformed by the pressing portion may be in a range of 0.6 to 0.9.

An aerosol generating device according to one embodiment may include the vaporizer described above, an air inlet through which external air is introduced, and the air passage communicating with the air inlet and an aerosol generating space.

In addition, the aerosol generating device may further include a case into which a cigarette is insertable, a heater that heats the cigarette inserted in the case, and a delivery passage for delivering an aerosol generated in the aerosol generating space to one end of the cigarette.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Throughout the specification, a term "up-down direction" may be defined based on, for example, a direction in which gravity acts when a user uses an aerosol generating device. In addition, a direction perpendicular to the "up-down direction" may be described as a "side direction".

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 and 2 are diagrams showing examples in which a cigarette is inserted into an aerosol generating device.

Referring to FIGS. 1 and 2, an aerosol generating device 100 includes a battery 110, a controller 120, a vaporizer 130, and a heater 140. Also, a cigarette 200 may be inserted into an inner space of the aerosol generating device 100.

The elements of the aerosol generating device 100 according to an embodiment are illustrated in FIGS. 1 and 2. Accordingly, it can be understood by those skilled in the art that other general-purpose elements other than the elements illustrated in FIGS. 1 and 2 may be further included in the aerosol generating device 100. For example, the aerosol generating device 100 may further include a case which forms an exterior and into which a cigarette may be inserted.

Also, FIGS. 1 and 2 illustrate that the aerosol generating device 100 includes the heater 140. However, as necessary, the heater 140 may be omitted.

FIG. 1 illustrates that the battery 110, the controller 120, the vaporizer 130, and the heater 140 are arranged in series. Also, FIG. 2 illustrates that the vaporizer 130 and the heater 140 are arranged in parallel. However, the internal structure of the aerosol generating device 100 is not limited to the structures illustrated in FIG. 1 or FIG. 2. In other words, according to the design of the aerosol generating device 100, the battery 110, the controller 120, the vaporizer 130, and the heater 140 may be differently arranged.

When the cigarette 200 is inserted into the aerosol generating device 100, the aerosol generating device 100 may operate the vaporizer 130, or the vaporizer 130 and the heater 140, to generate an aerosol. The aerosol generated by the vaporizer 130 or by the vaporizer 130 and the heater 140 passes through the cigarette 200 to be delivered to a user.

Even when the cigarette 200 is not inserted into the aerosol generating device 100, the aerosol generating device 100 may heat the heater 140 as necessary.

The battery 110 may supply power to be used for the aerosol generating device 100 operate. For example, the battery 110 may supply power to heat the vaporizer 130 or the heater 140 and may supply power for operating the controller 120. Also, the battery 110 may supply power for operations of a display, a sensor, a motor, etc. mounted in the aerosol generating device 100.

For example, the battery 110 may include a lithium-ion battery, a nickel-based battery (for example, a nickel-metal hydride battery or a nickel-cadmium battery), or a lithium-based battery (for example, a lithium-cobalt battery, a lithium-phosphate battery, a lithium titanate battery, or a lithium-polymer battery).

The controller 120 may generally control operations of the aerosol generating device 100. In detail, the controller 120 may control not only operations of the battery 110, the vaporizer 130, and the heater 140, but also operations of other components included in the aerosol generating device 100. Also, the controller 120 may check a state of each of the components of the aerosol generating device 100 to determine whether or not the aerosol generating device 100 is able to operate.

The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The vaporizer 130 may generate an aerosol by heating a liquid composition, and the generated aerosol may pass through a cigarette to be delivered to a user. For example, the aerosol generating device 100 may further include a delivery passage (not illustrated) for delivering an aerosol generated by the vaporizer 130 to one end of the cigarette 200 inserted into the aerosol generating device 100. In other words, the aerosol generated by the vaporizer 130 may move along the delivery passage of the aerosol generating device 100, and the delivery passage may be configured so that the aerosol generated by the vaporizer 130 passes through the cigarette to be delivered to a user.

For example, the vaporizer 130 may include a liquid storage, a liquid delivery element, and a heating element, but it is not limited thereto. For example, the liquid storage, the liquid delivery element, and the heating element may be included in the aerosol generating device 100 as independent modules.

The liquid storage may store a liquid composition. For example, the liquid composition may be a liquid including a tobacco-containing material having a volatile tobacco flavor component, or a liquid including a non-tobacco material. Also, the liquid composition may be an aerosol generating material. The liquid storage may be formed to be attached/detached to/from the vaporizer 130 or may be formed integrally with the vaporizer 130.

The liquid storage may function as a container directly containing the liquid composition, or may include an element such as sponge, cotton, cloth, or a porous ceramic structure, which contains the liquid composition.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 130 may be referred to as a cartomizer or an atomizer, but it is not limited thereto.

The heater 140 may be heated by power supplied from the battery 110 to heat a cigarette inserted into the aerosol generating device 100. For example, when a cigarette is inserted into the aerosol generating device 100, the heater 140 may be inserted into the cigarette or may be located outside the cigarette. Accordingly, the heated heater 140 may increase a temperature of the aerosol generating material included in the cigarette.

The heater 140 may include an electro-resistive heater. For example, the heater 140 may include an electrically conductive track, and the heater 140 may be heated when currents flow through the electrically conductive track. However, the heater 140 is not limited to the example described above and may include all heaters which may be heated to a desired temperature. Here, the desired temperature may be pre-set in the aerosol generating device 100 or may be set as a temperature desired by a user.

As another example, the heater 140 may include an induction heater. In detail, the heater 140 may include an electrically conductive coil for heating a cigarette in an induction heating method, and the cigarette may include a susceptor which may be heated by the induction heater.

FIGS. 1 and 2 illustrate that the heater 140 is positioned outside the cigarette 200, but the position of the cigarette 200 is not limited thereto. For example, the heater 140 may include a tube-type heating element, a plate-type heating element, a needle-type heating element, or a rod-type heating element, and may heat the inside or the outside of the cigarette 200, according to the shape of the heating element.

Also, the aerosol generating device 100 may include a plurality of heaters 140. Here, the plurality of heaters 140 may be inserted into the cigarette 200 or may be arranged outside the cigarette 200. Also, some of the plurality of heaters 140 may be inserted into the cigarette 200, and the others may be arranged outside the cigarette 200. In addition, the shape of the heater 140 is not limited to the shapes illustrated in FIGS. 1 and 2 and may include various shapes.

The aerosol generating device 100 may further include general-purpose components in addition to the battery 110, the controller 120, the vaporizer 130, and the heater 140. For example, the aerosol generating device 100 may include a display capable of outputting visual information and/or a motor for outputting haptic information. Also, the aerosol generating device 100 may include at least one sensor. Also, the aerosol generating device 100 may be formed as a structure where, even when the cigarette 200 is inserted into the aerosol generating device 100, external air may be introduced or internal air may be discharged.

Although not illustrated in FIGS. 1 and 2, the aerosol generating device 100 and an additional cradle may form together a system. For example, the cradle may be used to charge the battery 110 of the aerosol generating device 100. Alternatively, the vaporizer 130 and the heater 140 may be heated when the cradle and the aerosol generating device 100 are coupled to each other.

The cigarette 200 may be similar as a general combustive cigarette. For example, the cigarette 200 may be divided into a first portion including an aerosol generating material and a second portion including a filter, etc. Alternatively, the second portion of the cigarette 200 may also include an aerosol generating material. For example, an aerosol generating material made in the form of granules or capsules may be inserted into the second portion.

The entire first portion may be inserted into the aerosol generating device 100, and the second portion may be exposed to the outside. Alternatively, only a portion of the first portion may be inserted into the aerosol generating device 100, or a portion of the first portion and a portion of the second portion may be inserted thereinto. The user may puff aerosol white holding the second portion by the mouth of the user. In this case, the aerosol is generated by the external air passing through the first portion, and the generated aerosol passes through the second portion and is delivered to the user's mouth.

As an example, external air may be introduced through at least one air inlet formed in the aerosol generating device 100. For example, the opening and closing of the air inlet formed in the aerosol generating device 100 and/or a size of the air inlet may be controlled by a user. Accordingly, the amount of atomization and a smoking feeling may be adjusted by the user. In addition, air introduced through the air inlet may be delivered to the vaporizer 130, for example, an aerosol generating space to be described below, through the air passage. As another example, external air may also be introduced into the cigarette 200 through at least one hole formed in a surface of the cigarette 200.

FIG. 3 is an exploded view illustrating an embodiment of a cigarette illustrated in FIGS. 1 and 2.

Referring to FIG. 3, the cigarette 200 may include a tobacco rod 210 and a filter rod 220. The first portion described above with reference to FIGS. 1 and 2 may include the tobacco rod 210, and the second portion may include the filter rod 220.

FIG. 3 illustrates that the filter rod 220 includes a single segment. However, the filter rod 220 is not limited thereto. In other words, the filter rod 220 may include a plurality of segments. For example, the filter rod 220 may include a first segment configured to cool an aerosol and a second segment configured to filter a certain component included in the aerosol. Also, according to necessity, the filter rod 220 may further include at least one segment configured to perform other functions.

The cigarette 20 may be packaged by at least one wrapper 240. The wrapper 240 may have at least one hole through which external air may be introduced or internal air may be discharged. For example, the cigarette 200 may be packaged by one wrapper 240. As another example, the cigarette 200 may be doubly packaged by at least two wrappers 240. For example, the tobacco rod 210 may be packaged by a first wrapper, and the filter rod 220 may be packaged by a second wrapper. Also, the tobacco rod 210 and the filter rod 220, which are respectively packaged by separate wrappers, may be coupled to each other, and the entire cigarette 200 may be packaged by a third wrapper. When each of the tobacco rod 210 and the filter rod 220 includes a plurality of segments, each segment may be packaged by a separate wrapper. Also, the entire cigarette 200 including the plurality of segments, which are respectively packaged by the separate wrappers and coupled to each other, may be re-packaged by another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet.

Also, the tobacco rod 210 may be surrounded by a heat conductive material. For example, the heat-conducting material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may generate a flavor or an aerosol. For example, the capsule 230 may have a con figuration in which a liquid containing a flavoring material is wrapped with a film. For example, the capsule 230 may have a spherical or cylindrical shape, but is not limited thereto.

When the filter rod 220 includes a cooling segment for cooling an aerosol, the cooling segment may be made of a polymer material or a biodegradable polymer material. For example, the cooling segment may be made of only pure polylactic acid. Alternatively, the cooling segment may be made of a cellulose acetate filter including a plurality of perforations. However, the cooling segment is not limited to the above-described example and may be composed of a structure and a material for cooling an aerosol.

Furthermore, although not illustrated in FIG. 3, the cigarette 200 may further include a front end plug. The front end plug may be located on one side of the tobacco rod 210 which is opposite to the filter rod 220. The front end plug may prevent the tobacco rod 210 from escaping to the outside and may prevent a liquefied aerosol from flowing into the aerosol generating device 100 from the tobacco rod 210 during smoking.

FIG. 4 is a cross-sectional view of a side surface of a vaporizer illustrated in FIGS. 1 and 2.

Referring to FIG. 4, the vaporizer 130 may include a liquid storage 1300 for storing an aerosol generating material, an upper cap 131, a lower cap 132 that forms an aerosol generating space together with the upper cap 131 by being combined with the upper cap 131, a liquid delivery element 133 that absorbs an aerosol generating material and maintains the aerosol generating material in an optimal state for conversion into an aerosol, and a heating element 134 that generates an aerosol by heating the liquid delivery element 133.

A liquid inlet 1312 through which an aerosol generating material is introduced may be firmed in the upper cap 131 so that the aerosol generating material is delivered from the liquid storage 1300 to the liquid delivery element 133.

In the embodiment illustrated in FIG. 4, the liquid delivery element 133 may be arranged in, for example, an aerosol generating space. The heating element 134 may be wound around the liquid delivery element 133, and when the liquid delivery element 133 is heated by the heating element 134, an aerosol generating material held in the liquid delivery element 133 is vaporized to generate an aerosol.

A structure of the liquid delivery element 133, the heating element 134, the upper cap 131, and the lower cap 132 illustrated in FIG. 4 is an example and may be modified in various forms. For example, the heating element 134 may be arranged adjacent to the liquid delivery element 133 without being wound around the liquid delivery element 133, the structure of the liquid delivery element 133 may be modified to a mesh shape or a plate shape, and the heating element, 134 and the liquid delivery element 133 may be integrated into one element. For example, the heating element 134 and the liquid delivery element 133 may be implemented as a metal heater having a mesh shape.

The lower cap 132 includes the a support groove 1321 and inner walls 1322, which will be described in detail below with reference to FIGS. 5-6.

FIG. 5 is a horizontal cross-sectional view of an upper surface of the vaporizer illustrated in FIGS. 1 and 2, and FIG. 6 is a vertical cross-sectional view of a side surface of the vaporizer illustrated in a direction perpendicular to the direction illustrated in FIG. 4.

Referring to FIGS. 5 and 6, the lower cap 132 supports the liquid delivery element 133. The lower cap 132 includes a support groove 1321 for supporting at least a part of the liquid delivery element 133 and inner walls 1322 that respectively face both ends of the liquid delivery element 133. In this case, both ends of the liquid delivery element 133 may be spaced apart from the inner walls 1322, respectively. As such, a space may be formed between both ends of the liquid delivery element 133 and the respective inner walls 1322, and an aerosol generating material delivered from the liquid storage may be held in the space. Accordingly, the amount of aerosol to be generated may be increased. For example, a length $d_2$ by which one end of the liquid delivery element 133 is spaced apart from the inner wall 32 may range from 0.1 mm to 3 mm, preferably may range from 0.5 mm to 2.5 mm, and more preferably may range from 1 mm to 2 mm.

The support groove 1321 of the lower cap 132 supports both ends of the liquid delivery element 133. The support groove 1321 extends from the inner wall 1322 toward a center of the lower cap 132. Because an airflow passage through which external air is introduced into the aerosol generating space communicates with the center of the lower cap 132, it is preferable to prevent an aerosol generating material from being introduced into the center of the lower cap 132. For example, by increasing the contact area between the liquid delivery element 133 and the support groove 1321, an aerosol generating material may be prevented from leaking. The contact area between the liquid delivery element 133 and the support, groove 1321 may be increased by increasing a length of the support groove 1321 extending from the inner walls 1322 toward the center of the lower cap 132. For example, if a ratio of a length $d_1$ of the support groove 1321 to a length $d_2$ of a distance between one end of the liquid delivery element 133 and the inner wall 1322 facing the one end of the liquid delivery element 133 is set to be in a range of 1.1 to 35, the amount of generated aerosol may be increased and leakage of the aerosol may be prevented.

An aerosol generating material is delivered to the liquid delivery element 133 through the liquid inlet 1312 of the upper cap 131. Accordingly, as an area of the liquid inlet 1312 of the upper cap 131 increases, the amount, of the aerosol generating material delivered to the liquid delivery element 133 increases. As described above, an aerosol generating material is also held in a space between both ends of the liquid delivery element 133 and the respective inner walls 1322. In this respect, if the amount of the aerosol generating material delivered through the liquid inlet 1312 of the upper cap 131 is large, the aerosol generating material is likely to leak. In addition, if the amount of aerosol generating material delivered through the liquid inlet 1312 of the upper cap 131 is small, the aerosol generating material needs to be held in a space between both ends of the liquid delivery element 133 and the respective inner walls 1322 so that an aerosol may be generated sufficiently. Accordingly, an area of the liquid inlet 1312 of the upper cap 131 may be reduced as a distance between one end of the liquid delivery element 133 and corresponding the inner wall 1322 increases. For example, the area of the liquid inlet 1312 of the upper cap 131 may range from 5 $mm^2$ to 10 $mm^2$, and it may be inversely proportional to the distance between one end of the liquid delivery element 133 and the inner wall 1322.

Referring to FIGS. 4 and 6, the upper cap 131 may include a pressing portion 1311 extending toward the lower cap 132 to press the liquid delivery element 133 toward the lower cap 132. The pressing portion 1311 may be formed integrally with the upper cap 131 or may be formed separately from the upper cap 131 to be coupled to the upper cap 131. The liquid delivery element 133 may be stably supported in the aerosol generating space 62 by being pressed by the pressing portion 1311.

The liquid delivery element 133 may be deformed due to pressing at a portion pressed by the pressing portion 1311. The density of the pressed portion may increase in proportion to the degree of the deformation. In this case, the liquid delivery element 133 may not be able to smoothly deliver the liquid (i.e., aerosol generating material), which may lead to reduction of the amount of aerosol. Accordingly, by adjusting the degree of deformation of the liquid delivery element 133 to a predetermined range, the liquid delivery element 133 may be stably supported while maintaining the amount of generated aerosol at an appropriate level. For example, a ratio of a height $l_2$ of the liquid delivery element 133 after deformation due to the pressing portion 1311 to a height $l_1$ of the liquid delivery element 133 before deformation may be in a range of 0.6 to 0.9.

FIGS. 4-5 illustrate that the support groove 1321 and inner wall 1322 have symmetrical structures, but according to embodiments, the support groove 1321 and inner walls 1322 may have asymmetrical structures.

At least one of the components, elements, modules or units (collectively "components" in this paragraph) represented by a block in the drawings such as the controller 120 shown in FIGS. 1-2, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. A vaporizer comprising:

a liquid storage configured to store an aerosol generating material;

an upper cap having a liquid inlet through which the aerosol generating material is introduced;

a lower cap coupled to the upper cap such that an aerosol generating space is formed between the lower cap and the upper cap;

a liquid delivery element arranged in the aerosol generating space and configured to absorb the aerosol generating material delivered from the liquid storage; and a heating element configured to generate an aerosol by heating the aerosol generating material absorbed by the liquid delivery element, wherein the lower cap includes a support groove for supporting at least part of the liquid delivery element, and an inner wall facing an end of the liquid delivery element, wherein the upper cap includes a pressing portion configured to press the liquid delivery element toward the lower cap, and wherein a ratio of a height of the liquid delivery element after being deformed by the pressing portion to a height of the liquid delivery element before being deformed by the pressing portion is in a range of 0.6 to 0.9.

2. The vaporizer of claim 1, wherein the end of the liquid delivery element is spaced apart from the inner wall.

3. The vaporizer of claim 2, wherein the support groove extends from the inner wall of the lower cap toward a center of the lower cap to support the end of the liquid delivery element.

4. The vaporizer of claim 3, wherein a ratio of a length of the support groove to a distance between the end of the liquid delivery element and the inner wall is in a range of 1.1 to 35.

5. The vaporizer of claim 4, wherein the distance between the end of the liquid delivery element and the inner wall is in a range of 0.1 mm to 3 mm.

6. The vaporizer of claim 5, wherein an area of the liquid inlet is reduced as the distance between the end of the liquid delivery element and the inner wall increases.

7. The vaporizer of claim 6, wherein the area of the liquid inlet is in a range of 5 mm2 to 10 mm2.

8. An aerosol generating device comprising:

the vaporizer of claim 1;

an air inlet through which external air is introduced; and an air passage communicating with the air inlet and the aerosol generating space.

9. The aerosol generating device of claim 8, further comprising:

a case into which a cigarette is insertable;

a heater configured to heat the cigarette inserted in the case; and a delivery passage configured to deliver an aerosol generated in the aerosol generating space to one end of the cigarette.

* * * * *